US005339619A

United States Patent [19]

Antonellis

[11] Patent Number: 5,339,619

[45] Date of Patent: Aug. 23, 1994

[54] ACTIVE COOLING OF TURBINE ROTOR ASSEMBLY

[75] Inventor: Stephen M. Antonellis, Woodbury, Conn.

[73] Assignee: United Technologies Corporation, Hartford, Conn.

[21] Appl. No.: 937,927

[22] Filed: Aug. 31, 1992

[51] Int. Cl.[5] ..... B64C 11/00

[52] U.S. Cl. ..... 60/39.02; 416/95; 416/220 R

[58] Field of Search ..... 60/39.75, 39.02; 416/219 R, 220 R, 95

[56] References Cited

U.S. PATENT DOCUMENTS

| | | | |
|---|---|---|---|
| 3,137,478 | 6/1964 | Farrell | 416/220 R |
| 3,733,146 | 5/1973 | Smith et al. | 415/172 |
| 3,887,298 | 6/1975 | Hess et al. | 416/220 R |
| 4,344,738 | 8/1982 | Kelly et al. | 416/95 |
| 4,439,107 | 3/1984 | Antonellis | 416/95 |
| 4,484,858 | 11/1984 | Kurosawa et al. | 416/95 |
| 4,523,890 | 6/1985 | Thompson | 416/95 |
| 4,659,285 | 4/1987 | Kalogeros et al. | 416/95 |
| 4,890,981 | 1/1990 | Corsmeier | 416/95 |
| 5,201,849 | 4/1993 | Chambers et al. | 416/95 |

FOREIGN PATENT DOCUMENTS

| | | | |
|---|---|---|---|
| 0169800 | 1/1986 | European Pat. Off. | 416/219 R |
| 1491480 | 11/1977 | United Kingdom | 416/219 R |

*Primary Examiner*—Richard E. Gluck
*Assistant Examiner*—Howard R. Richman

[57] ABSTRACT

An active cooling mechanism for a turbine disk is disclosed. Various construction details are developed which disclose a turbine section having a rotor assembly, a disk with an attachment means, a radially movable heat shield disposed therebetween, and a cooling passage which directs cooling air over the forward surface and radially outer surface of the attachment means. During operation, rotational forces urge the heat shield radially outward to create a gap between the heat shield and the attachment means, the gap defining a portion of the cooling passage.

15 Claims, 3 Drawing Sheets

*fig. 3*
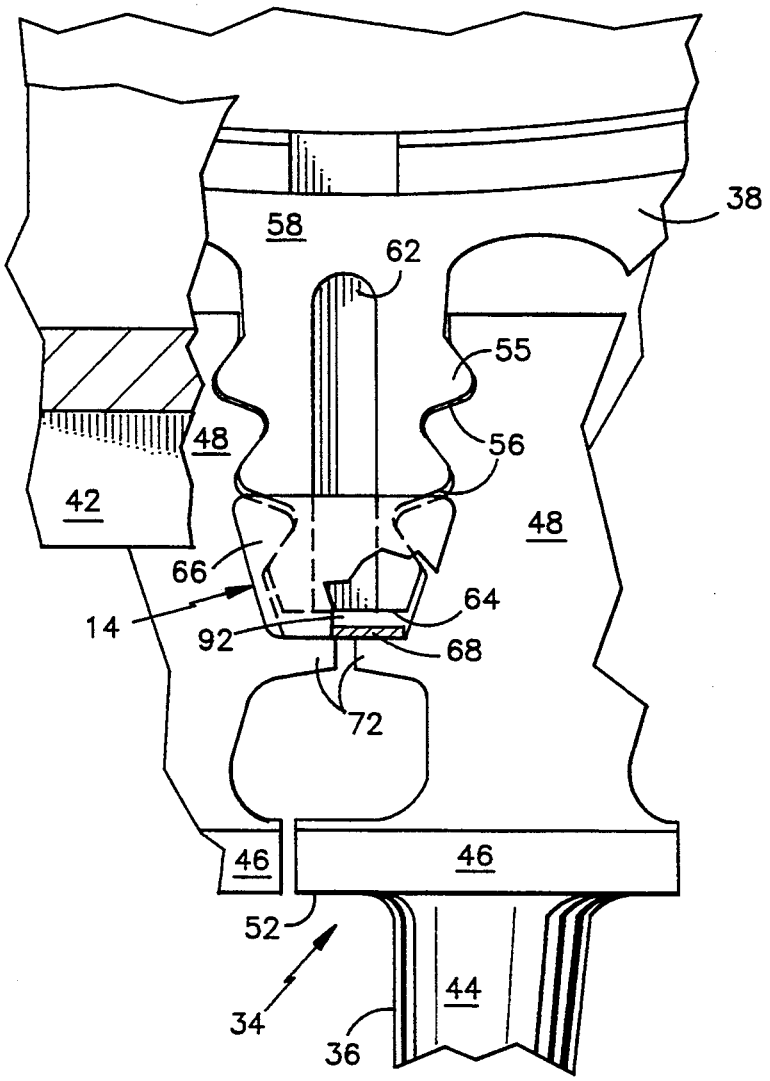
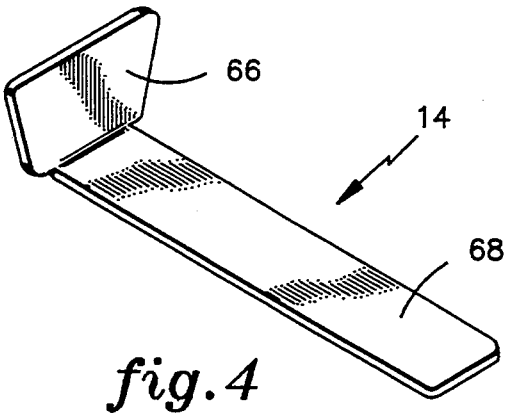
*fig. 4*

ACTIVE COOLING OF TURBINE ROTOR ASSEMBLY

TECHNICAL FIELD

This invention relates to gas turbine powerplants, and more particularly, to a method and apparatus for cooling a turbine rotor assembly.

BACKGROUND ART

A typical gas turbine engine has a compressor section, a combustion section, and a turbine section. The gas turbine engine includes an annular flowpath for conducting working fluid sequentially through the compressor section, the combustion section, and the turbine section. The compression section adds energy in form of momentum to the working fluid. The combustion section mixes fuel with the compressed working fluid and combusts the mixture. The products of combustion are expanded through the turbine section. The turbine section includes an array of airfoil shaped blades attached to rotating disks. The interaction of the working fluid and the turbine blades transfers energy to the rotating disks. The rotating disks are connected to the compressor section by a shaft. In this way, a portion of the energy removed from the expanding working fluid is used to compress incoming working fluid in the compressor section.

The output of the gas turbine engine is dependent in part upon the energy added to the fluid in the combustion section. The combustion section adds energy in the form of heat to the working fluid. The amount of heat added to the working fluid is limited by the temperature characteristics of the turbine section components. The turbine blades, disks and other turbine structure have material temperature characteristics which limit the temperature of the working fluid exiting the combustion section.

One particular area of concern in gas turbine engines is the blade attachment mechanism of the rotating disk. Typically, the disk has a plurality of axially oriented dove-tail or fir-tree shaped slots. The plurality of blades have root portions which are shaped to accommodate the slot to provide a retaining mechanism against radially outwardly directed rotational forces. The high rotational speeds of the disk causes the blade attachment region to be an area of very high stress in the disk. The allowable stress of the disk material for either static loading or fatigue loading, decreases as the temperature of the disk increases.

The disk attachment stress rupture life may be extended by either reducing the stress in the disk or by reducing the temperature of the highly stressed region of the disk. Reducing the stress in the disk may be accomplished by reducing the size and weight of the blades attached to the disk. In most situations, however, the size and design of the blades has been optimized for efficient performance of the gas turbine engine. Therefore, reducing the stress by altering the size and weight of the blades may not be a practical option. Reducing the temperature of the blade attachment region of the disk has been accomplished with some measure of success in the prior art. In U.S. Pat. No. 3,733,146, issued to Smith and Voyer, entitled "Rotating Seal For A Gas Turbine Engine", a cover plate for the disk attachment region was disclosed. The cover plate provided a aerodynamically smooth flow surface to reduce windage losses in the blade attachment region of the disk. In U.S. Pat. No. 4,659,285, issued to Kalogeros and Chaplin, entitled "Turbine Cover Seal Assembly", an improved cover plate for the blade attachment region of the disk was disclosed. This cover plate provided both a windage cover and insulated the disk rim from the working fluid.

The above art notwithstanding, scientists and engineers under the direction of Applicant's Assignee are working to develop methods and apparatus for minimizing the temperature of the blade attachment region of rotating disks.

DISCLOSURE OF INVENTION

According to the present invention, a gas turbine engine includes a rotatable disk having attachment means to secure a plurality of blades to the disk and a cooling passage in communication with a source of cooling fluid which directs cooling fluid over a forward face and radially outer face of the attachment means.

According further, a gas turbine engine includes a heat shield disposed radially between the attachment means and the plurality of blades, wherein the heat shield insulates the attachment means from the working fluid and wherein the heat shield defines a flow surface for the cooling passage.

According to a specific embodiment of the present invention, the attachment means includes a radially extending slot in the forward face, the heat shield includes a first portion extending radially and circumferentially over the forward face of the disk and a second portion extending axially and circumferentially over the radially outer surface of the attachment means. The cooling passage includes a first passage defined by the slot and the first portion of the heat shield, and a second passage defined by the radially outer surface of the attachment means and the second portion of the heat shield. During rotation of the disk, the heat shield moves radially outward to seat against the radially adjacent root portion of the blade to produce a separation between the second portion of the heat shield and the radially outer surface and thereby define the second passage.

According further to the present invention, a method of cooling a turbine disk having a heat shield includes the steps of: rotating the disk such that the heat shield seats against an adjacent blade and a passage is defined; conducting cooling fluid into the passage and ejecting cooling fluid from the passage.

A primary feature of the present invention is the active cooling of the blade attachment region of the disk. Another feature is the heat shield which extends over a portion of the forward surface of the blade attachment region and over the radially outer surface. A further feature is the radial movement of the heat shield during rotation of the disk to produce a cooling passage. A still further feature is the radially extending groove in the forward surface of the blade attachment region.

A primary advantage of the present invention is the stress rupture life of the disk attachment region as a result of the cooling provided by the flow of cooling fluid through the cooling passage. Lowering the temperature of the blade attachment means increases the allowable stress of the attachment means therefore extends the stress rupture life of the disk. Another advantage is the ease of fabrication and reduced stress in the heat shield as a result of the heat shield floating in the gap between the outer surface and the radially adjacent blades. By permitting the heat shield to float the heat shield is easy to install between the blade and disk and the heat shield does not carry the load or stress of the blades and disk. A further advantage is the cooling passage provided by the groove which permits cooling fluid to be passed between the disk and adjacent turbine structure and up along the forward face of the disk.

The foregoing and other objects, features and advantages of the present invention become apparent in light of the following detailed description of the exemplary embodiments thereof, as illustrated in the accompanying drawings.

BRIEF DESCRIPTION OF THE DRAWINGS

FIG. 3 is a view taken along line 3—3 of FIG. 2 which shows an axial view of a rotor blade assembly without the side plate.

FIG. 4 is a perspective view of a heat shield.

BEST MODE FOR CARRYING OUT THE INVENTION

Figure 1:
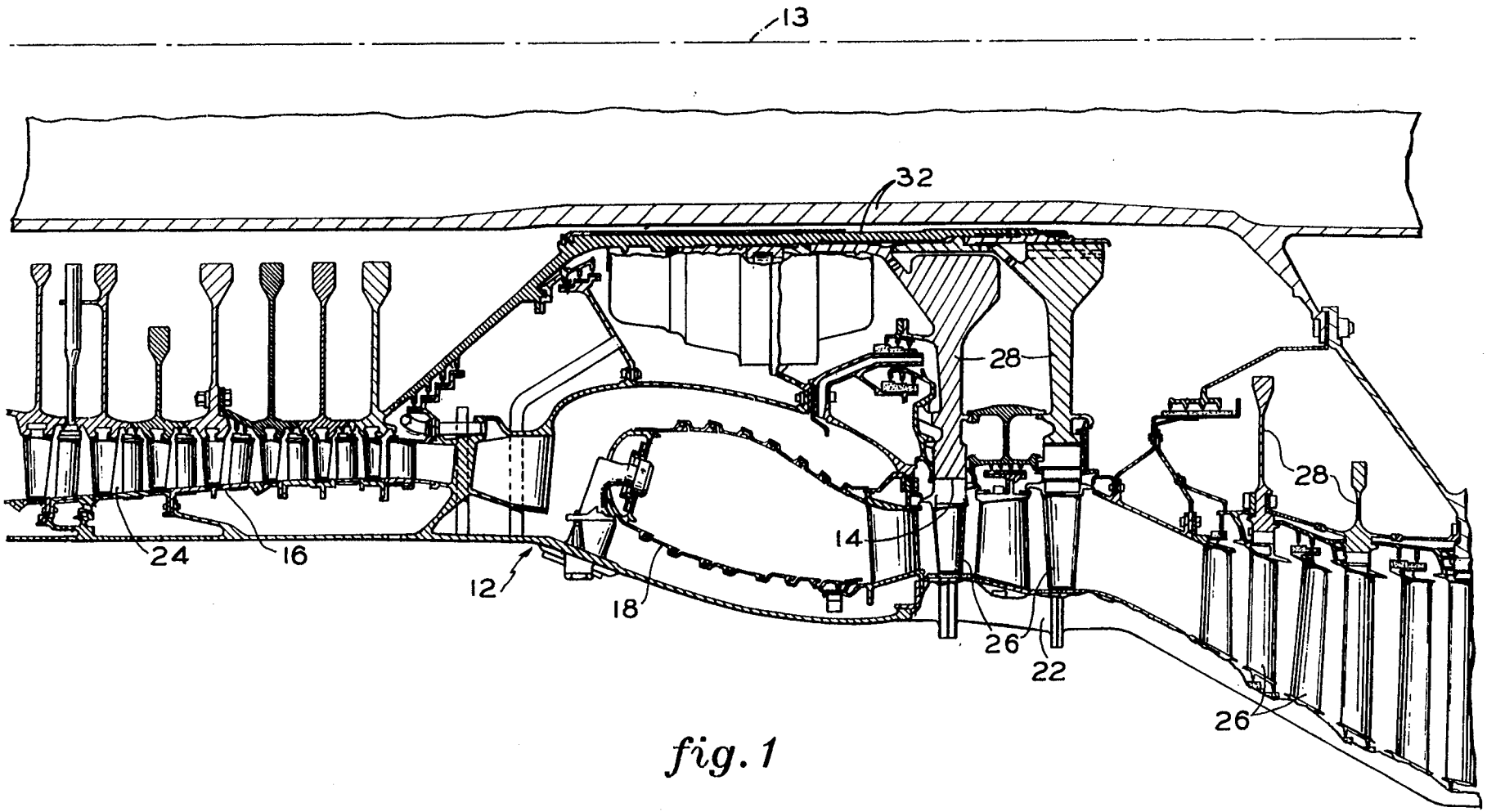
FIG. 1 is a cross-sectional view of a gas turbine engine.

FIG. 1 is an illustration of a gas turbine engine 12 having a heat shield 14. The gas turbine engine includes a compressor section 16, a combustion section 18, and a turbine section 22. An axially extending flow passage 24 extends through the gas turbine engine and passes working fluid sequentially through the compressor section, the combustion section, and the turbine section. Energy, in the form of increased momentum, is added to the working fluid entering the compression section. The working fluid then passes into the combustion section. In the combustion section, fuel is added to the compressed working fluid and the mixture is combusted. The hot working fluid is then expanded through the turbine section. The turbine section includes a plurality of blades 26 which are attached to rotating disks 28. The rotating disks are attached to shafts 32 which interconnect the compression section and turbine section. The engagement of the blades with the expanding working fluid transfers energy from the working fluid to the rotating disks. A portion of the rotational energy in the disk is then transferred to the compressor section via the shafts where it is used to compress incoming working fluid.

Figure 2:
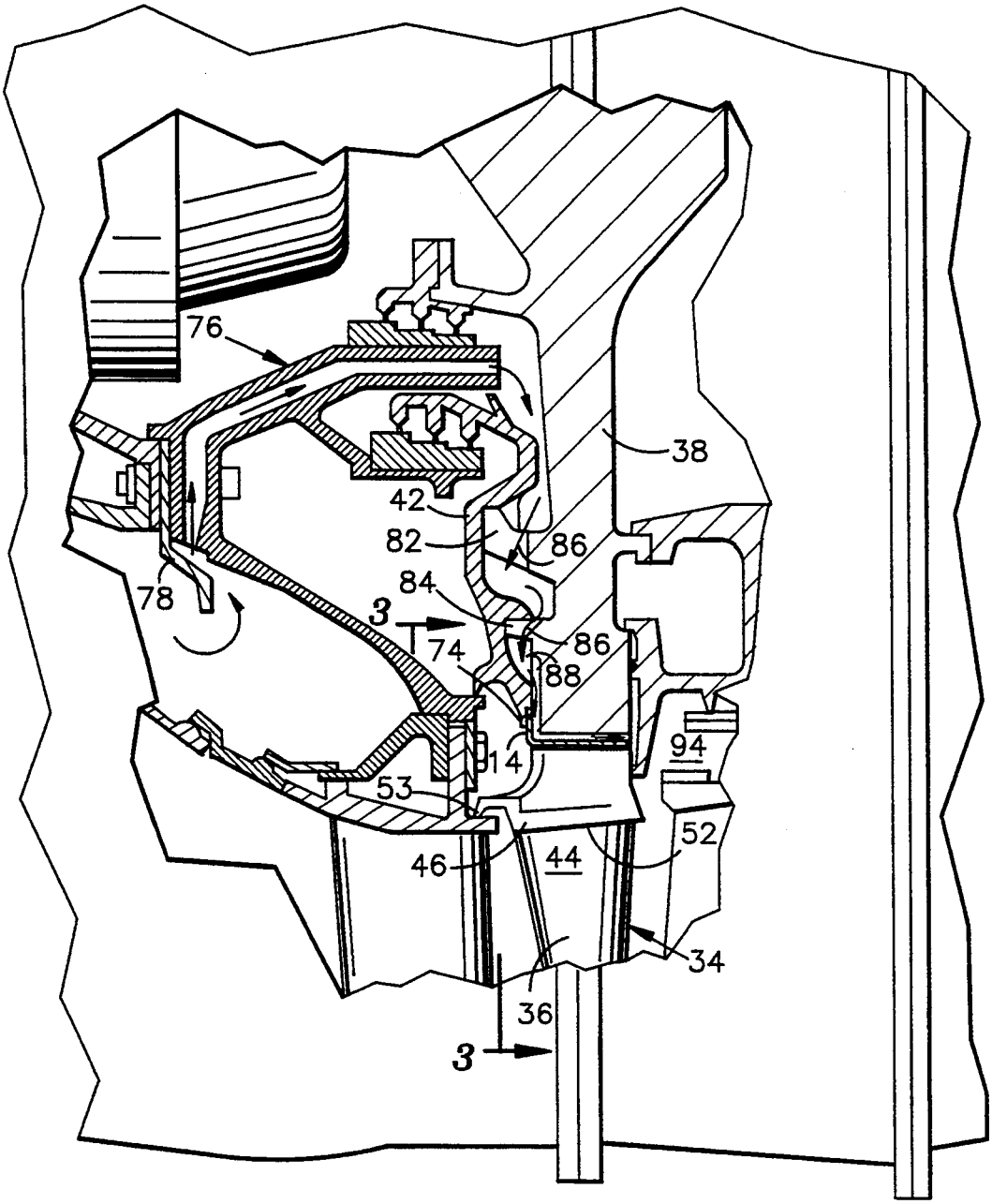
FIG. 2 is a side view of a rotor blade assembly partially cut away to show a heat shield.

FIGS. 2 and 3 illustrate a rotor blade assembly 34 of the gas turbine engine. The rotor blade assembly includes a rotor blade 36, the heat shield 14, a disk 38, and a side plate 42. The blade includes an airfoil portion 44, a platform 46, and a blade root 48. The airfoil portion extends across the flowpath and interacts with the expanding working fluid in the turbine section. The platform includes a radially inner flow surface 52 for the working fluid and sealing means 53 engaged with adjacent structure. The sealing means blocks the radially inward flow of hot working fluid into a cavity defined by the blade root, disk and side plate. As shown in FIG. 2, the sealing means includes a knife-edge seal. The root portion engages the disk to attach the blade to the disk.

The disk includes attachment means 55 which engages the root portion of the blades to attach to the disk and the blades. As shown in FIGS. 2 and 3, the attachment means is comprised of a plurality of fir-tree shaped slots 56 which extend axially. The root portion of the blades are also fir-tree shaped to compliment the shape of the slots. Each blade is inserted by sliding the root portion axially into a slot.

The attachment means includes an axially forward surface 58 having a radially extending groove 62 and a radially outer surface 64. The surfaces 58, 64 are the radially outermost surfaces of the disk and are exposed to the highest temperature environment due to the proximity to the working fluid flowpath. In the prior art, these surfaces are in direct contact with working fluid which escapes around seal means 53.

The heat shield has a first portion 66 which extends radially and circumferentially over the forward surface 58 and a second portion 68 which extends axially and laterally over the outer surface 64. The heat shield is held in place radially by projections 72 which extend circumferentially from adjacent blade root portions. The heat shield is retained axially by being sandwiched between a radial extension 74 of the side plate and the forward surface of the disk.

The gas turbine engine further includes means 76 to conduct cooling fluid into the turbine section. The means to conduct cooling fluid includes means 78 for removing working fluid from the compressor section and channeling the removed working fluid into the turbine section and bypassing the combustion section. The side plate and disk include slots 82, 84 which define passages 86 to permit cooling fluid to pass into an inner cavity 88 between the side plate and the forward surface of the disk. The inner cavity is in communication with the groove. Although the structure illustrated in FIG. 1 is one means of providing cooling fluid to the cavity and groove, other sources of cooling fluid and other means of conducting the fluid to the cavity and groove may be used without departing from the spirit and scope of the invention.

During operation, the disk is rotated as a result of the exchange of energy between the working fluid and the turbine blades. The rotational energy causes the heat shield to move radially outward and to seat against the circumferential projections of the turbine blades. By seating against the turbine blades, the heat shield causes a gap 92 to occur between the heat shield and the outer surface. The gap is in fluid communication with the groove. Cooling fluid enters the cavity through the slot and then passes into the groove. The cooling fluid passes radially outward along the groove. As the cooling fluid reaches the radially outermost edge of the forward surface, the heat shield urges the cooling fluid to flow axially down the gap between the heat shield and the outer surface. At the downstream end of the heat shield, the cooling fluid is ejected out into a cavity 94 downstream of the rotor blade assembly where it is mixed with working fluid and passes through the turbine section. The cooling fluid provides active cooling of the attachment means as it passes along the forward surface and the outer surface. The heat shield blocks the attachment means from coming into direct contact with working fluid. Although the platform includes sealing means to prevent working fluid from flowing radially inward of the platform, some working fluid escapes around the sealing means and passes radially between the side plate assembly, the disk and the platform. The heat shield acts as a fluid barrier to prevent this fluid from coming into direct contact with the disk and attachment means. The heat shield may also be formed from thermally insulative material to provide a thermal barrier between the disk and hot working fluid. As a thermal barrier, the heat shield will block the conduction of heat from the working fluid flowpath.

Although the invention has been shown and described with respect to detailed embodiments thereof, it will be understood by those skilled in the art that various changes in the form and detail thereof may be made without departing from the spirit and scope of the claimed invention.

I claim:

1. A method of cooling a turbine disk, the turbine disk disposed about a longitudinal axis and including a blade attachment means adapted to attach a blade to the disk, the attachment means including an axially forward facing surface having a radially extending groove and a radially outer surface, and a heat shield, the heat shield disposed between the blade attachment means and a pair of circumferentially adjacent blades, the heat shield having a first portion extending radially and circumferentially over the forward surface and a second portion extending axially and laterally over the outer surface, and wherein the groove and the heat shield defines in part a radially extending cooling passage therebetween, the method including the steps of:

rotating the disk such that the heat shield seats against the pair of blades thereby producing a radial separation between the heat shield and the outer surface of the attachment means, the separation defining an axially extending cooling passage in communication with the radially extending cooling passage;

conducting cooling fluid into the radially extending cooling passage; and ejecting cooling fluid from the axially extending cooling passage.

2. A gas turbine engine disposed about a longitudinal axis and having an axially extending flow passage, a combustion section and a turbine section downstream of the combustion section, the turbine section including a plurality of airfoil shaped blades adapted to engage working fluid exiting the combustion section, a rotatable disk including attachment means adapted to secure the blades to the disk, the attachment means having an axially forward facing front surface and a radially outward facing top surface, a first cooling passage extending radially over the front surface, a second cooling passage extending axially over the top surface, each of the cooling passages in fluid communication with the other of the cooling passages, and means to conduct cooling fluid into the first cooling passages, wherein the cooling fluid flows through the first and second cooling passages and exits the second cooling passage.

3. The gas turbine according to claim 2, further including a heat shield disposed between the attachment means and circumferentially adjacent blades, the heat shield adapted to block contact between the working fluid and the front and top surfaces, and wherein the cooling passages are defined in part by the heat shield and the attachment means.

4. The gas turbine according to claim 3, wherein the heat shield includes a first portion extending radially and circumferentially over the front surface of the attachment means and a second portion extending axially and laterally over the top surface of the attachment means.

5. The gas turbine according to claim 4, further including a radial gap between each of the top surfaces of the attachment means and a radially adjacent surface of each of the blades, and wherein the second portion of the heat shield has a thickness, measured in the radial direction, less than the radial width of the radial gap and wherein the heat shield is adapted to seat against the radially adjacent surfaces of the blades during rotation of the disk to thereby produce an axially extending, radial separation between the heat shield and the top surface, the radial separation produced thereby defining in part the second cooling passage.

6. The gas turbine according to claim 5, further including a first groove extending radially outward in the front surface and wherein the first cooling passage is defined in part by the first groove.

7. A rotor assembly for a turbomachine, the turbomachine disposed about a longitudinal axis and including an axially extending flow passage, a combustion section and a turbine section, the turbine section including a plurality of airfoil shaped blades adapted to engage working fluid exiting the combustion section, a rotatable disk including attachment means adapted to secure the blades to the disk, the attachment means having an axially forward facing front surface and a radially outward facing top surface, a first cooling passage extending radially over the front surface, a second cooling passage extending axially over the top surface, each of the cooling passages in fluid communication with the other of the cooling passages, and means to conduct cooling fluid through the cooling passages.

8. The rotor assembly according to claim 7, further including a heat shield disposed between the attachment means and circumferentially adjacent blades, the heat shield adapted to block contact between the working fluid and the front and top surfaces, and wherein the cooling passages are defined in part by the heat shield and the attachment means.

9. The rotor assembly according to claim 8, wherein the heat shield includes a first portion extending radially and circumferentially over the front surface of the attachment means and a second portion extending axially and laterally over the top surface of the attachment means.

10. The rotor assembly according to claim 9, further including a radial gap between each of the top surfaces of the attachment means and a radially adjacent surface of each of the blades, and wherein the second portion of the heat shield has a thickness, measured in the radial direction, less than the radial width of the radial gap and wherein the heat shield is adapted to seat against the radially adjacent surfaces of the blades during rotation of the disk to thereby produce an axially extending, radial separation between the heat shield and the top surface, the radial separation produced thereby defining in part the second cooling passage.

11. The rotor assembly according to claim 10, further including a first groove extending radially outward in the front surface and wherein the first cooling passage is defined in part by the first groove.

12. A heat shield for a gas turbine engine disposed about a longitudinal axis and having an axially extending flow passage, a combustion section and a turbine section downstream of the combustion section, the turbine section including a plurality of airfoil shaped blades adapted to engage working fluid exiting the combustion section, a rotatable disk including attachment means adapted to secure the blades to the disk, the attachment means having an axially forward facing front surface and a radially outward facing top surface, a first cooling passage extending radially over the front surface, a second cooling passage extending axially over the top surface, each of the cooling passages in fluid communication with the other of the cooling passages, and means to conduct cooling fluid through the cooling passages and further including a heat shield disposed between the attachment means and circumferentially adjacent blades, the heat shield adapted to block contact between the working fluid and the front and top surfaces, and wherein the cooling passages are defined in part by the heat shield and the attachment means.

13. The heat shield according to claim 12, wherein the heat shield includes a first portion extending radially and circumferentially over the front surface of the attachment means and a second portion extending axially and laterally over the top surface of the attachment means.

14. The heat shield according to claim 13, further including a radial gap between each of the top surfaces of the attachment means and a radially adjacent surface of each of the blades, and wherein the second portion of the heat shield has a thickness, measured in the radial direction, less than the radial width of the radial gap and wherein the heat shield is adapted to seat against the radially adjacent surfaces of the blades during rotation of the disk to thereby produce an axially extending, radial separation between the heat shield and the top surface, the radial separation produced thereby defining in part the second cooling passage.

15. The heat shield according to claim 14, further including a first groove extending radially outward in the front surface and wherein the first cooling passage is defined in part by the first groove.

* * * * *